US012465155B2

(12) United States Patent
Kerstenne et al.

(10) Patent No.: US 12,465,155 B2
(45) Date of Patent: Nov. 11, 2025

(54) DEVICE FOR PRESENTING AN OBJECT

(71) Applicant: LEVITA, SPRL, Liège (BE)

(72) Inventors: Clément Kerstenne, Liège (BE); Philippe Bougard, Ans (BE); François Royen, Donceel (BE)

(73) Assignee: LEVITA, SPRL, Liège (BE)

( * ) Notice: Subject to any disclaimer, the term of this patent is extended or adjusted under 35 U.S.C. 154(b) by 829 days.

(21) Appl. No.: 17/639,274

(22) PCT Filed: Aug. 27, 2020

(86) PCT No.: PCT/EP2020/073939

§ 371 (c)(1),
(2) Date: Feb. 28, 2022

(87) PCT Pub. No.: WO2021/037959

PCT Pub. Date: Mar. 4, 2021

(65) Prior Publication Data

US 2022/0330719 A1 Oct. 20, 2022

(30) Foreign Application Priority Data

Aug. 29, 2019 (BE) ..... 2019/5563

(51) Int. Cl.

| | |
|---|---|
| ***A47F 3/08*** | (2006.01) |
| ***A47F 7/02*** | (2006.01) |
| ***A47F 7/19*** | (2006.01) |
| ***A47F 11/10*** | (2006.01) |

(52) U.S. Cl.

CPC ..... *A47F 3/08* (2013.01); *A47F 7/022* (2013.01); *A47F 7/19* (2013.01); *A47F 11/10* (2013.01)

(58) Field of Classification Search

CPC .... A47F 3/08; A47F 7/022; A47F 7/19; A47F 11/10

USPC ..... 40/429, 417, 463–470; 273/447–448; 472/72–80

See application file for complete search history.

(56) References Cited

U.S. PATENT DOCUMENTS

| | | | | |
|---|---|---|---|---|
| 382,582 | A * | 5/1888 | Arthur | A63J 1/02 472/75 |
| 1,993,545 | A | 3/1935 | Gentry et al. | |
| 2,579,807 | A * | 12/1951 | Egolf, Sr. | G09F 11/23 472/76 |
| 2,932,919 | A * | 4/1960 | Evans | A63J 19/00 40/418 |

(Continued)

FOREIGN PATENT DOCUMENTS

| | | | |
|---|---|---|---|
| DE | 120905 | C | 7/1900 |
| DE | 202018001181 | U1 | 5/2018 |

(Continued)

OTHER PUBLICATIONS

International Search Report mailed Sep. 17, 2020, issued in corresponding International Patent Application No. PCT/EP2020/073939, filed Aug. 27, 2020, 3 pages.

*Primary Examiner* — Cassandra Davis
(74) *Attorney, Agent, or Firm* — CHRISTENSEN O'CONNOR JOHNSON KINDNESS PLLC

(57) ABSTRACT

Object display device including an exhibition area including a visibility portion of the object to be exhibited and a technical area, said exhibition area being arranged to contain an object to be exhibited.

18 Claims, 8 Drawing Sheets

(56) References Cited

U.S. PATENT DOCUMENTS

| | | | | |
|---|---|---|---|---|
| 3,812,611 | A * | 5/1974 | Bierwiler | A63J 19/00 446/84 |
| 4,123,865 | A * | 11/1978 | Pearson | G09F 19/02 472/75 |
| 5,232,105 | A | 8/1993 | Gregg | |
| 6,770,001 | B1 * | 8/2004 | Shoemaker, Jr. | G07F 11/1657 273/448 |
| 2004/0261303 | A1 | 12/2004 | White et al. | |
| 2007/0114725 | A1 * | 5/2007 | Peck | G07F 17/3253 273/447 |
| 2012/0228828 | A1 * | 9/2012 | Riggles | A63F 9/30 273/447 |
| 2015/0124164 | A1 | 5/2015 | Sin et al. | |

FOREIGN PATENT DOCUMENTS

| | | | |
|---|---|---|---|
| FR | 2712785 | A1 | 6/1995 |
| GB | 2 098 041 | A | 11/1982 |

* cited by examiner

DEVICE FOR PRESENTING AN OBJECT

CROSS-REFERENCES TO RELATED APPLICATION

This application is a National Stage of International Application No. PCT/EP2020/073939 filed Aug. 27, 2020, and is based on Belgium Application No. 2019/5563 filed Aug. 29, 2019, the entire disclosures of which are hereby incorporated by reference.

The present invention relates to an object display stand.

There are different types of display stands to showcase objects. For example, there are display stands such as conventional display cases in shop windows in which multiple objects for sale may be exhibited.

There are also display stands used inside shops in which multiple objects are exhibited in a single display stand that is smaller than a conventional display case. These display stands may be present by the dozen on a single shop floor.

In our current hyper-connected and ever-improving society, it is becoming difficult to capture the attention of consumers in shops with such conventional display cases or display stands for objects.

There are also display stands which allow for interaction between the consumer and the exhibited object via a barcode to be scanned using a smartphone.

Some shops or shopping centres, at important times of the year in terms of sales, for example, at Christmas, use displays comprising turntables, light effects such as blinking, flashing, animated backgrounds and moving objects such as automata.

Unfortunately, with such displays, which quickly become too busy, the consumer looks at all the moving objects in the display and the consumer is not able to concentrate on one object exhibited in the display because the light effects are intense and fluctuate, which therefore does not allow the potential consumer to focus on one object in particular, the consumer focusing mainly on the display.

Other display stands in which objects are located have been developed to capture the eye of the potential consumer.

For example, devices allowing an object to be held in the air under the influence of magnetic forces without any physical support provided to the object have been developed.

There are also other display stands such as a cabinet in which two identical objects are attached opposite one another using a transparent plate. The objects seem to only be one object and seem weightless in this type of cabinet.

Unfortunately, this type of device requires, in general, a modification of the object in addition to having to have two copies of the object and the object is also, in some cases, lost. Furthermore, the consumer is neither sufficiently interested in a still object nor the aesthetic of this type of device.

There is also a display stand as described in the document CN 107149347. This document describes an all-directional display device for a smartwatch. This device is rotated and contains a smartwatch hanging from a hook which may be picked up by the consumer via a motorised "fishing rod" system and then put back into the display stand.

Unfortunately, with such a device, the means of movement can only function alternatively to each another. The device is rotated and when a consumer wants to take the smartwatch, they press the button on the switch of the fishing rod system. The rotation system stops and the watch can then be wound up and the consumer can take it off the hook.

Furthermore, the mechanism allowing the object to move is visible to the consumer, without mentioning that the extremely regular result of the movement is boring without particularly showcasing the object.

The document US2015/124164 discloses a display box with a transparent display panel, behind which a display object is displayed. The displayed object may move by different means of movement, for example a suspension means. The display object may be displayed through the transparent display panel while the rest of the panel is opaque. However, this display approach has the disadvantage that the effect depends on the viewing angle of the user and therefore requires very complex detection and control or it does not function correctly.

There is therefore a need to develop a display stand that allows an object to be showcased, for example, a luxury object such as a watch or a piece of jewellery. This type of display stand must capture the attention of the potential consumer and awaken their curiosity while holding their attention on the object.

To resolve this problem, the invention provides an object display device which comprises an exhibition area and a technical area, said exhibition area comprising a visibility portion of the object to be exhibited, said exhibition area being arranged to contain an object to be exhibited and said technical area containing means for moving the object to be exhibited, isolated in said technical area and arranged to provide movement to said object to be exhibited, said means for moving the object comprising at least one motorised means and at least one transmission means arranged to transmit a movement provided by said at least one motorised means to said object to be exhibited, said transmission means comprising at least one suspension element arranged to be connected via a first part to the object to be exhibited and via a second part to said at least one motorised means, the device comprising at least one light source, the combination of said at least one light source and the means of movement is arranged to make said at least one suspension element invisible (to the consumer).

Surprisingly, the combination of said at least one light source and (the suspension element) the means of movement results in the object seeming to levitate but also seeming to move weightlessly. The term "which seems to levitate" means an object that seems to float statically in the space of the display stand without a visible physical support. The combination of said at least one light source and the means for moving the object deceives the eye by creating an optical illusion and the consumer cannot detect that the object is in fact suspended by a suspension element and depends on motorised means, said suspension element being made invisible. Said at least one motorised means therefore allows the object to be exhibited to move along a predetermined or random trajectory. The suspension element is therefore moved by said at least one motorised means. The object does not only seem to float in the air, but, if the motorised means are supplied by an operational motor, then the object also performs a first movement in space along the X-, Y- or Z-axis or performs a first clockwise or anti-clockwise rotation without the suspension element being visible to the naked eye and without apparent force exerted on the object in order to move it.

The lighting of the light source is such that it enhances/enables the suspension element to be made invisible. Therefore, when the light source is turned on, the suspension element disappears or disappears even more for the consumer who is looking at the object.

As can be seen, the device according to the present invention becomes fun for the potential consumer who is unable to stop looking at the object moving as if it was levitating, all while holding their attention on the object and not on the movement mechanism.

To resolve this problem, an object display device is provided comprising a visibility portion of the object to be exhibited, the device being arranged to contain an object to be exhibited, said device comprising at least one suspension element arranged to be connected via a first part to the object to be exhibited and via a second part to said device, the device comprising at least one light source, the combination of said at least one light source and the means of movement is arranged to make said at least one suspension element invisible.

Surprisingly, the combination of said at least one light source and the suspension element results in the object seeming to levitate. The combination of said at least one light source and the suspension element deceives the eye by creating an optical illusion and the consumer cannot detect that the object is in fact suspended by a suspension element, said suspension element being made invisible.

The following embodiments define preferred and/or optional implementations.

Preferably, at least one second object to be exhibited is exhibited with the first object.

Preferably, for the purposes of the present invention, the term "first part of said suspension element" means a part, segment or distal end of said suspension element.

Preferably, for the purposes of the present invention, the term "second part of said suspension element" means a part, segment or one or both proximal end(s) of said suspension element.

Preferably, the device according to the present invention comprises an exhibition area which allows the object to be exhibited to be shown using a visibility portion included in this exhibition area and comprises a technical area.

Preferably, in the technical area, all the means of movement are located so that they are not visible. The means of movement are therefore isolated from the exhibition area.

Preferably, the visibility portion (V) of the object to be exhibited is visible (to the consumer of the device).

Preferably, the visibility portion of the object to be exhibited allows the consumer to see the object to be exhibited in the exhibition area. The visibility portion comprises or consists of a transparent element, for example, glass or Plexiglas. The transparent element may for example be a transparent window through which the consumer can look into (the exhibition area of) the device to see the object to be exhibited. The device, the visibility portion and/or the transparent element do not comprise a transparent screen.

Preferably, said technical area is not visible (to a consumer of the device) and/or is hidden behind a front wall. This allows the means of movement to be hidden from the user in said technical area.

Preferably, said first suspension element connected to the object to be exhibited is located in said exhibition area and/or in the visibility portion. This causes the object to be exhibited connected to the invisible suspension element to seem to levitate in the exhibition area.

Preferably, the second part of the suspension element connected to said at least one motorised means is located in said technical area. This allows the second part of the suspension element connected to said at least one motorised means to be hidden from the user in said technical area.

For the purposes of the present invention, the conventional mathematical reference frame X, Y, Z of the coordinates in space is used. X representing the X-axis and therefore the horizontal axis, Y representing the Y-axis and therefore the vertical axis and Z representing the depth.

Preferably, the at least one light source is arranged to provide an indirect lighting, preferably an indirect lighting of said object to be exhibited and/or said at least one suspension element.

Preferably, said at least one light source comprises at least one first light source and at least one second light source. Preferably, said at least one first light source to light the background and/or to create an indirect lighting (of said object to be exhibited and/or said at least one suspension element). Preferably, said at least one second light source is arranged to light with a direct lighting said object to be exhibited and/or said at least one suspension element.

Preferably, said at least one second light source is arranged so that the (specular) reflection of the direct lighting of the suspension element is not visible to the consumer and/or does not leave the visibility area. The first light source distracts the eye of the consumer from seeing the suspension element. The second light source lights the object to be exhibited without creating a reflection from the suspension element towards the consumer. The combination of the first and second light sources lights the object without the suspension element being visible.

Preferably, said at least one light source is located in said exhibition area, arranged to provide an indirect lighting of said object to be exhibited. The said at least one light source is placed in the exhibition area, outside the visibility portion.

The indirect lighting may be directed towards the rear of the exhibition area to obtain a diffuse reflection of said at least one light source, a small part of the reflection of which lights up the object to be exhibited.

Alternatively, the suspension element may not be in the range of the light beam that indirectly lights up the object to be exhibited.

Alternatively, the light beam is directed from bottom to top, or from top to bottom or sideways in the exhibition area so that the suspension element is not in the direct light beam, but in the indirect light beam, which is optionally amplified using mirrors, for example.

Preferably, said light source is arranged to direct a light beam from the light source so that the suspension element is not in the direct light beam but is in the indirect light beam.

Preferably, said light source is arranged to provide an indirect lighting of said object to be exhibited so that the object to be exhibited (O) is not directly targeted by the light beams but becomes perfectly visible thanks to the diffusely reflected indirect light. Therefore, the suspension element disappears from the vision of a consumer in front of the display stand.

Advantageously, said means of movement comprising at least one motorised means of the device according to the present invention comprise at least one first motorised means arranged to provide a first X-axis, Y-axis or Z-axis component in a mathematical reference frame or a first circular component. Said at least one first motorised means therefore allows a sideways movement from right to left, a vertical movement from bottom to top or a depth movement from front to back to be provided to the object to be exhibited using the suspension element which transmits the movement of said at least one motorised means to the object to be exhibited.

Advantageously, said means of movement comprising at least one motorised means of the device according to the present invention further comprise a second motorised means arranged to provide a second X-axis, Y-axis or Z-axis component, which is different to the first, in a mathematical reference frame or a second circular component. Said predefined trajectory has a first X component and a second Y component or vice versa, a first X component and a second Z component or vice versa, a first X component and a second circular component or vice versa, a first Y component and a second Z component or vice versa, a first Y component and a second circular component or vice versa, or even a first Z component and a second circular component or vice versa.

More advantageously, said means of movement comprising at least one motorised means of the device according to the present invention further comprise a third motorised means arranged to provide a third X-axis, Y-axis or Z-axis component which is different to the first and second component, in a mathematical reference frame or a third circular component. Said predefined trajectory has a first X component, a second Y component and a third Z component or vice versa, a first X component, a second Y component and a third circular component or vice versa, a first X component, a second Z component and a third circular component or vice versa, or even a first Y component, a second Z component or a third circular component.

Even more advantageously, said means of movement comprising at least one motorised means of the device according to the present invention further comprise a fourth motorised means arranged to provide a fourth X-axis, Y-axis or Z-axis component which is different to the first, second and third component, in a mathematical reference frame or a third circular component. Said predefined trajectory has a first X component, a second Y component, a third Z component and a circular component or vice versa.

Advantageously, the device according to the present invention further comprises a background.

In this advantageous embodiment, the background is opaque and consists of a woven or non-woven fabric comprising plant or synthetic fibres absorbing a significant amount of light and reflecting light. This fabric is preferably a black fabric, a felt or a dark-coloured fabric comprising bright fibres, impurities or light-reflecting particles, i.e. elements in the fabric which reflect light. Even more advantageously, the background is, for example, synthetic grass, a metal plate comprising numerous holes or comprising grooves. The background advantageously comprises a significant number of elements (fibres, holes, grooves, etc.) to be analysed by the eye at the same time.

Advantageously, the background is arranged to create the indirect lighting. Preferably, the indirect lighting is created by a reflection of light from the said at least one (first) light source by the background. Preferably, the background creates a complex indirect lighting that captures the attention of the eye. Preferably, the background (complex) comprises a raised surface (non-flat) and/or reflective/bright elements. The complex indirect lighting (reflected by the background) deceives the eye of the consumer and makes the suspension element invisible to the consumer. Preferably, the background is opaque. Advantageously, the background is dark in colour, for example black. Advantageously, the background is a fabric or a felt. Advantageously, the background and/or the felt and/or the fabric comprises elements that reflect light (from the at least one light source). Preferably, the background and the suspension element reflect light equally. This does not allow the eye to view the suspension element in front of the background.

In an example, the background is a transparent material such as glass or transparent plastic. Preferably, the background of transparent material is curved to create the complexity which helps to hide the suspension element from the eye of the consumer. The background may also comprise reflective/bright elements. The reflective/bright elements may be made from irregularities in the surface or by inserting elements of other materials. The background in this example is preferably made of the same materials as the visibility portion. Preferably, the background and the visibility portion are a window that allows a 360° view of the object.

Preferably, the combination of said at least one light source, the means of movement (particularly the suspension element) and the background is arranged to make the suspension element invisible (to the consumer). This combination allows the effect where the object levitates to be improved and helps to make the suspension element invisible to the naked eye.

Preferably, said at least one light source is arranged to provide an indirect lighting of said object to be exhibited and/or said at least one suspension element by reflecting a direct lighting from said at least one light source by the background.

Preferably, the combination of said at least one light source (L), the means of movement and the background (F) is arranged so that light is absorbed by the background and so that light is reflected by the light-reflecting elements in the background which allows light homogeneity to be created on the background which makes the suspension element invisible.

Advantageously, the suspension element is located between the eye of the consumer and the background of the exhibition area. The background may also comprise side walls in said exhibition area so that the suspension element is invisible to eye of the consumer for the whole time that the consumer is looking at the object to be exhibited.

Advantageously, said at least one light source of the device according to the present invention comprises LEDs. Preferably, the LEDs used have an angle greater than 120°, preferably greater than 130°, preferably greater than 145°. Preferably, the LEDs used have an angle smaller than 180°, preferably smaller than 170°, preferably smaller than 160°, preferably smaller than 150°. Preferably, the LEDs are wide-angle LEDs. Preferably, the LEDs used have an angle of between 140° and 160°, even more preferably, the LEDs have an angle of 150°. Preferably, the LEDs are arranged in at least one row on the inside of one of the two side walls defining the exhibition area. Preferably, the LEDs are arranged in at least two rows, each row being arranged on the inside of the two side walls defining the exhibition area. Even more preferably, the LEDs are arranged in at least 3 rows, a first row being arranged on the inside of the right or left side wall defining the exhibition area, a second row being arranged on the inside of the left or right wall defining the exhibition area, a third row being arranged on the inside of the lower wall defining the exhibition area.

The term "wide-angle LED" means a light source diffusing light in a beam forming an angle of 140° and 160° between the edges of the beam.

Furthermore, the combination of said at least one light source, preferably said at least one light source comprising wide-angle LEDs arranged in a row on the inside of at least one wall defining the exhibition area, the means of movement and the background allows the effect where the object levitates to be improved and helps to make the suspension element invisible to the naked eye. In fact, the light will be absorbed by the background and reflected by the bright fibres or light-reflecting elements present in the background which allows light homogeneity to be created on the background which makes the suspension element invisible.

Preferably, said at least one suspension element is a wire. The wire may be a monofilament wire, a cable or a multifilament wire or another wire-type element with a mainly one-dimensional extension. The wire is preferably elastic and is stretched by the weight of the suspended object.

Advantageously, said at least one suspension element according to the device according to the present invention is a monofilament wire.

In this preferred embodiment, said suspension element is a dark-coloured monofilament wire, for example, black, which, in combination with said at least one light source, becomes invisible to the naked eye.

In a variant according to the present invention, the exhibition area comprises a curved transparent wall which allows the dark background with bright/reflective particles to be omitted. The daylight reflected on the curved transparent wall ensures that the wire is not visible to the consumer.

In a preferred embodiment, said suspension element may also be a cable or a multifilament wire when, for example, the mass of the object to be exhibited is too heavy to be suspended by a monofilament wire. The cable in combination with said at least one light source becomes invisible to the naked eye.

In an even more advantageous embodiment, the device according to the present invention comprises a suspension element which is a black monofilament wire and the device further comprises a background such as a dark-coloured felt such as black or navy blue.

In this even more advantageous embodiment, the combination of the monofilament wire, said at least one light source comprising at least one row of wide-angle LEDs on the inside of at least one of the walls defining the exhibition area and the background such as a felt, creates a light homogeneity on this background which increases the effect where the object to be exhibited seems to levitate, since the monofilament wire is made invisible. In fact, when the background and the suspension element are illuminated by the LEDs, the background and the suspension element reflect light equally, which does not allow the eye to view the wire.

In a particular embodiment, the device according to the present invention comprises at least one first motor connected to at least one first motorised means and arranged to move said first motorised means.

In this particular embodiment, a motor is arranged to drive one or more motorised means which will then operate simultaneously and therefore the object to be exhibited necessarily moves in one direction of space and in a rotational movement.

In another preferred embodiment, the device according to the present invention comprises a second motor connected to said second motorised means and arranged to move said second motorised means.

In this preferred embodiment, a motor is connected to a single motorised means and arranged to move a single motorised means. A first motorised means may therefore be moved without a second motorised means being moved and it allows the second rotational movement to alternate with the first movement in the direction of space along the X-, Y- or Z-axis.

Advantageously, the device according to the present invention comprises a third motor connected to said third motorised means, the third motor being arranged to move said third motorised means. Even more advantageously, the device according to the present invention comprises a fourth motor connected to a fourth motorised means, said fourth motor being arranged to move said fourth motorised means. The first, third and fourth motorised means are each moved in a direction of space along a particular X-, Y- or Z-axis.

In an advantageous embodiment, said first motorised means comprises at least one axis around which the suspension element winds, said first motorised means being moved by the first motor.

According to another particular embodiment, in the device according to the present invention, said suspension element is arranged to be connected to the object to be exhibited and to said first motorised means which passes through at least one element arranged to provide an inflection point to said first or second movement provided to at least said second part of said suspension element, for example a passing ring, hook or pulley.

Advantageously, there may be one, two, three or more than three elements arranged to provide an inflection point to said first or second movement provided to at least said second part of said suspension element.

Furthermore, said elements arranged to provide an inflection point to said first or second movement provided to at least said second part are opposite the exhibited object relative to the technical area. Said suspension element passes through a first pulley arranged to provide a first inflection point to said first or second movement provided to said second part of said suspension element and a second pulley arranged to provide a second inflection point to said first or second movement provided to said first part of said suspension element.

Furthermore, the elements arranged to provide an inflection point to said first or second provided movement may be positioned elsewhere in the same technical area, or in another technical area.

In another preferred embodiment, the technical area of the device according to the present invention comprises at least one first guide rail, optionally, two first guide rails, extending in an X-axis direction or a Z-axis direction and wherein said first motorised means comprises a carriage moveable along said at least one guide rail. The moveable carriage allows movement in the selected X- or Z-axis direction.

Advantageously, the technical area of the device according to the present invention further comprises at least two second guide rails extending transversely relative to said at least one first guide rail, said first guide rail being slidably mounted in said second guide rails and being driven by said first motor or by a third motor.

In this preferred embodiment, the object to be exhibited performs a first movement in space in the X- or Z-axis direction, a second rotational movement and a third movement in space in the Z- or X-axis direction.

Alternatively, the device according to the invention comprises two first guide rails and two second guide rails sliding in a vertical structure to provide movement along the Y-axis to at least said first part of the suspension element.

Preferably, said second motorised means of the device according to the present invention comprises a first toothed wheel and a second toothed wheel, forming a gear, said first toothed wheel being the pinion of said gear and being moved by said first or second motor, said second toothed wheel being connected to said suspension element, optionally via a housing and providing said second rotational movement to at least said first part of said suspension element.

In this advantageous embodiment, the second toothed wheel rotates the housing, said housing comprises said first motor or said third motor, a third toothed wheel, said first motorised means or said third motorised means, said motorised means comprising two transverse axes around which the suspension element winds. A first end of said suspension element is attached to a first transverse axis, the second end of said suspension element is attached to the second transverse axis. Both transverse axes are moved and allow the object to be exhibited to move in the Y direction of space when said third toothed wheel is moved by said first motor or by said third motor.

In a preferred embodiment, the device according to the present invention comprises control means comprising an electronic card which allows the movement(s) provided by the motor(s) to be controlled.

In this preferred embodiment, said control means comprise a transmitter and a receiver, said receiver being located in said technical area and the control means allow the movement(s) to be controlled by transmitting a signal to the receiver, said transmitted signal resulting from the programming by the user.

Advantageously, the device according to the present invention further comprises a cushioning area such as a false floor comprising foam or a stretched fabric inside the lower wall defining the exhibition area.

In this particular embodiment, the cushioning area ensures that the object is not damaged should it fall from the suspension element.

Advantageously, the device according to the present invention further comprises brightness sensors that allow the brightness of said at least one light source to be adjusted according to the brightness of the room or the sun.

Even more advantageously, the device according to the present invention further comprises a sound card which allows a sound to be included in the device according to the invention, such as background music or relaxation music.

Preferably, the device according to the present invention further comprises Bluetooth and/or Wi-Fi sensors. These sensors allow at least two object display devices according to the present invention to be synchronised.

Alternatively, the objects in the same display cases or in different display stands may be synchronised and move in a predetermined trajectory.

Preferably, the at least one light source is located in said exhibition area. But it is also possible for the at least one light source to be located in the technical area.

In a preferred embodiment of the device according to the present invention, wherein said exhibition area comprises said at least one light source (L) located in said exhibition area, wherein said means of movement of the object to be exhibited (O) are arranged to provide a movement to said object to be exhibited (O) along a predefined trajectory.

In another embodiment of the device according to the present invention, wherein said exhibition area (E) and/or the visibility portion (V) of the object to be exhibited (O) is visible and said technical area (T) is not visible and/or is hidden behind a front wall.

Preferably, the at least one light source is arranged to provide a lighting of said object to be exhibited and/or said suspension element. Preferably, the at least one light source generates light beams. Indirect lighting is preferably the lighting of the light beams of the at least one first light source reflected at least once, preferably diffusely. Direct lighting is preferably the lighting of the light beams of the at least one (second) light source never reflected or reflected only in a specular manner. Diffuse lighting is preferably indirect lighting. It is also possible to create diffuse/indirect lighting by transmission.

Preferably, said transmission means may be the at least one suspension element or may comprise the at least one suspension element and other elements.

Other embodiments of the device according to the invention are mentioned in the appended claims.

Other features, details and advantages of the invention will emerge from the description below, which is non-limiting and refers to the drawings and examples.

In the drawings, FIG. 1 shows a perspective view of a particular embodiment of the device according to the present invention.

In the drawings, identical or similar elements use the same references.

Figure 1:
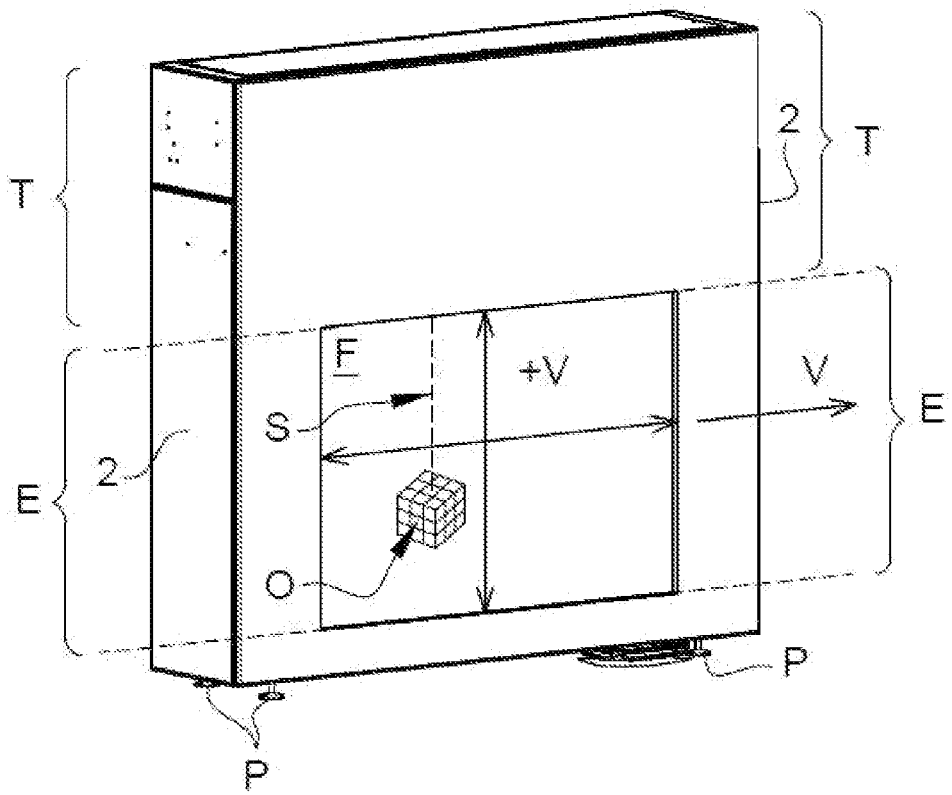

FIG. 1 shows an object display device comprising an exhibition area E comprising a visibility portion V of the object to be exhibited O and a technical area T, said exhibition area E being arranged to contain an object to be exhibited O suspended from a suspension element S and a background F covered with a dark-coloured fabric material including a plurality of particles, fibres and light-reflecting elements. Even more advantageously, the background F is, for example, synthetic grass, a metal plate comprising numerous holes or comprising grooves. The background advantageously comprises a significant number of elements (fibres, holes, grooves, etc.) to be analysed by the eye at the same time.

In the embodiment shown, the technical area T is above the exhibition area E. In certain variants, there may be several technical areas T. For example, the technical area T containing the means of movement is below, while another smaller technical area T may be provided above, simply provided with hooks, rings, pulleys, etc. The said device also comprises feet P which are adjustable in height to level the device and ensure that it is horizontal.

Figure 2:
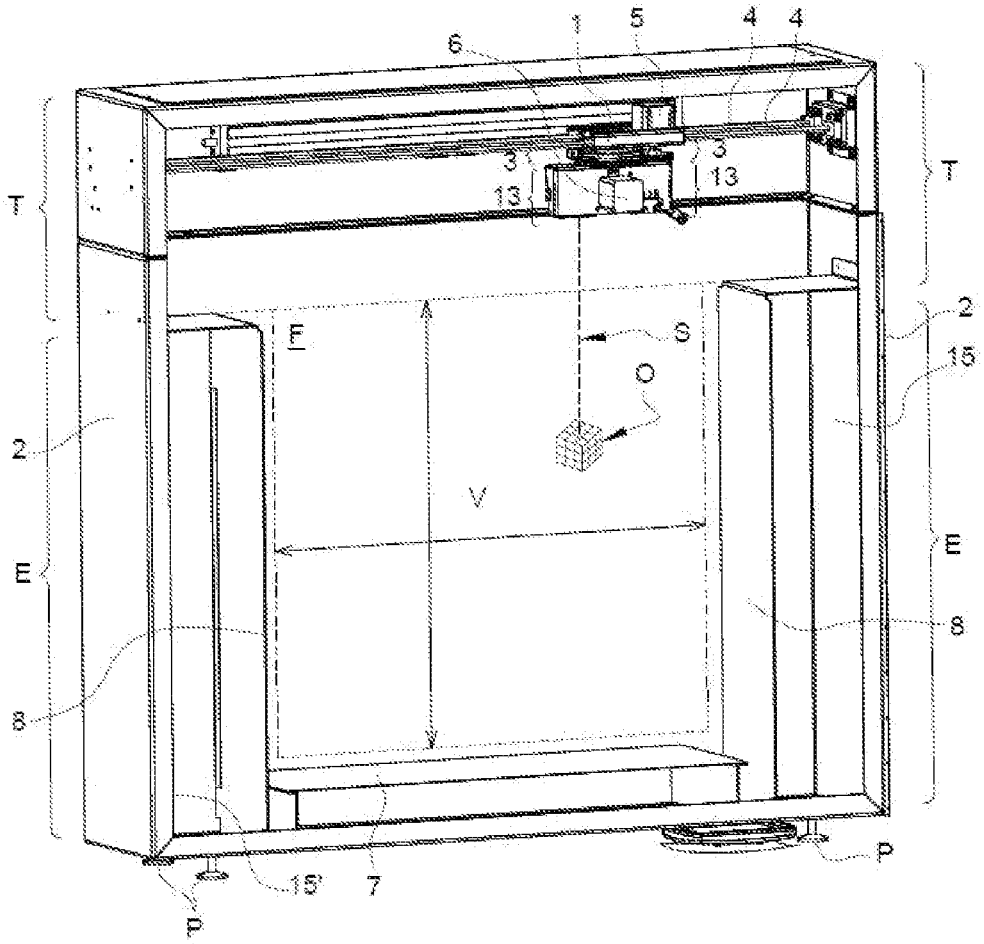
FIG. 2 shows a perspective view without the front wall of a particular embodiment of the device according to the present invention.

The technical area T is shown in FIG. 2 without the front wall. As can be seen, the area comprises two guide rails 4 parallel to one another and extending between the two side walls 2 of the device according to the invention. A carriage 1 (first motorised means) is mounted on these guide rails 4 and slides along them in the X direction. The carriage 1 is moved by a system comprising a first motor and a cable, not shown.

The second motorised means 3 is attached to the carriage 1. The second motorised means 3 comprises a rotating collector, a first toothed wheel 9 and a second toothed wheel 10. The first toothed wheel 9 acts as a pinion of the gear which is rotated by the second motor 5, which is positioned on the carriage 1, for example, on the opposite side of the attachment point of the first toothed wheel 9. The first toothed wheel 9 meshes the second toothed wheel 10 and thereby provides a rotational movement.

A housing 13 is attached to the second toothed wheel 10. The first toothed wheel 9 and the second toothed wheel 10 are rotated around a vertical axis and each have two substantially circular horizontal walls parallel to one another forming the base surface and the head surface of each toothed wheel 9 and 10. The housing 13 is attached to the base surface of the second toothed wheel 10 by a conventional attachment means. The housing 13 preferably comprises a front wall, two side walls, as well as a base wall and a head wall.

In the embodiment shown, the suspension element S is attached to the rear wall of the housing 13 at one end and to the object to be exhibited O at the other end. In this embodiment, the object to be exhibited O may therefore be moved along the X-axis thanks to the carriage 1 moving along the guide rails 4. The object to be exhibited O may be rotated by the second motorised means 3. It may further be moved along the Y-axis by the presence of a reel, not shown, attached to the rear wall of the housing 13. The reel is provided so that the suspension element S may be wound and unwound around a horizontal axis, which is rotated by the motor 6 in the winding or unwinding direction.

The device according to the invention further comprises a background F against the rear wall of the display stand inside it, in the exhibition area E which is visible through the visibility portion V. The exhibition area E further comprises two side partitions 8, each provided with a ceiling and a front wall which forms a first false wall 15 and a second false wall 15'. These false walls accommodate a light source, for example, incorporating LED technology and are positioned in such a way that the beams are directed towards the background F. The beam preferably has an angle between the two beam edges of between 140° and 160°. The background F is covered with a dark-coloured fabric material incorporating a plurality of particles, fibres and light-reflecting elements. In this manner, the object to be exhibited O is not directly targeted by the light beams but becomes perfectly visible thanks to the indirect light diffusely reflected by the background, while the suspension element disappears from the vision of a consumer in front of the display stand.

Furthermore, the device according to the invention comprises a cushioning area 7 in order to preserve the object to be exhibited O in case it falls, which is a stretched fabric or a block of foam.

Figure 3:
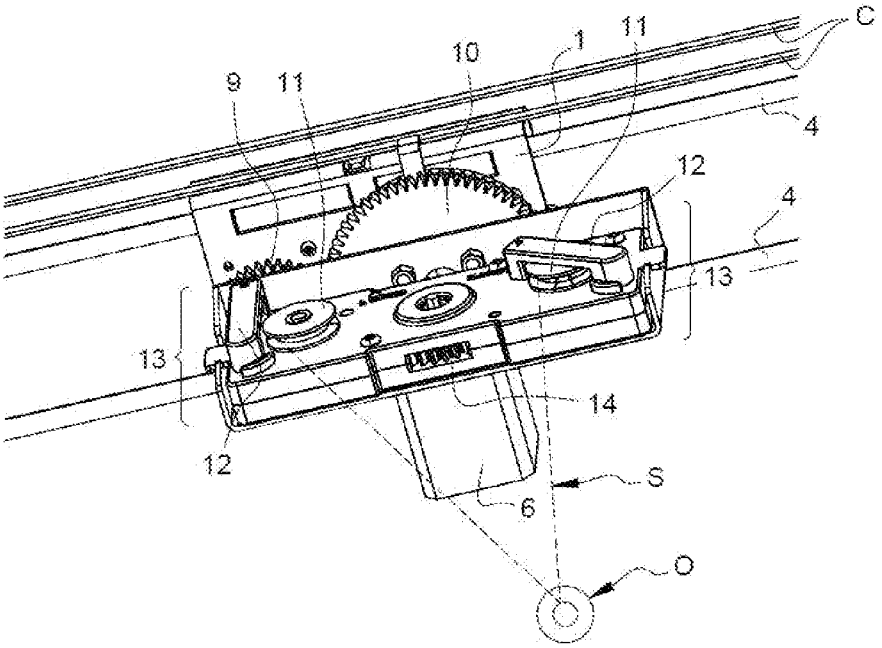
FIG. 3 shows a low-angle view of a particular embodiment of the technical area in detail of the device according to the present invention.

The technical area of FIG. 2 is shown in a detailed, low-angle view in FIG. 3. As can be seen, it comprises two guide rails 4 parallel to one another. A carriage 1 (first motorised means) is mounted on these guide rails 4 and slides along them in the X direction. The carriage 1 is moved by a system comprising a first motor, not shown, and a cable C.

The second motorised means 3 is attached to the carriage 1. The second motorised means 3 comprises a rotating collector, a first toothed wheel 9 and a second toothed wheel 10. The first toothed wheel 9 acts as a pinion of the gear which is rotated by the second motor 5, which is positioned on the carriage 1, for example, on the opposite side of the attachment point of the first toothed wheel 9. The first toothed wheel 9 meshes the second toothed wheel 10 and thereby provides a rotational movement.

A housing 13 is attached to the second toothed wheel 10. The first toothed wheel 9 and the second toothed wheel 10 are rotated around a vertical axis and each have two substantially circular horizontal walls parallel to one another forming the base surface and the head surface of each toothed wheel 9 and 10. The housing 13 is attached to the base surface of the second toothed wheel 10 by a conventional attachment means. The housing 13 preferably comprises a front wall, two side walls, as well as a base wall and a head wall.

In the embodiment shown, the suspension element S is attached to the rear wall of the housing 13 by its two ends, the object to be exhibited O being suspended on one part of the suspension element S.

In this embodiment, the object to be exhibited O may therefore be moved along the X-axis thanks to the carriage 1 moving along the guide rails 4. The object to be exhibited O may be rotated by the second motorised means 3. It may further be moved along the Y-axis by the presence of two reels 11 attached to the rear wall of the housing 13. The two reels 11 are provided so that the suspension element S may be wound and unwound around a horizontal axis, which is rotated by the motor 6 and a third toothed wheel 14 in the winding or unwinding direction.

Furthermore, the reels 11 are provided to be interchangeable, for example, when the suspension element S has to be replaced by a new suspension element S. The reels 11 may be locked by the locking system 12 and then cannot be removed from the housing 13 when said locking system 12 is set to "Closed". The reels 11 may not be locked by the locking system 12 when said locking system 12 is not set to "Closed". When the reels 11 are not locked by the locking system 12, the suspension element S may be replaced by removing each reel 11 from each horizontal axis. When the replacement of the suspension element S is performed and attached to the reels 11, the reels 11 may be returned to their horizontal axis and then be in the locked position when said locking system 12 is set to "Closed".

Figure 4:
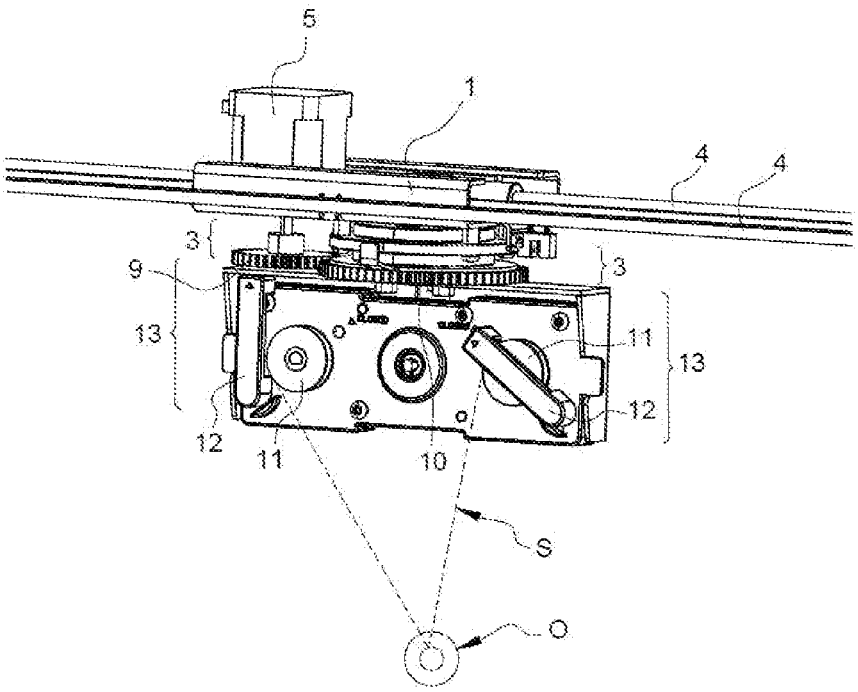
FIG. 4 shows a perspective view of a particular embodiment of the technical area in detail of the device according to the present invention.

The technical area T in FIG. 2 is shown in detail in FIG. 4 in a different view to FIG. 3. As can be seen, the area comprises two guide rails 4 parallel to one another. A carriage 1 (first motorised means) is mounted on these guide rails 4 and slides along them in the X direction. The carriage 1 is moved by a system comprising a motor, not shown, and a cable C.

The second motorised means 3 is attached to the carriage 1. The second motorised means 3 comprises a rotating collector, a first toothed wheel 9 and a second toothed wheel 10. The first toothed wheel 9 acts as a pinion of the gear which is rotated by the second motor 5, which is positioned on the carriage 1, for example, on the opposite side of the attachment point of the first toothed wheel 9. The first toothed wheel 9 meshes the second toothed wheel 10 and thereby provides a rotational movement.

A housing 13 is attached to the second toothed wheel 10. The first toothed wheel 9 and the second toothed wheel 10 are rotated around a vertical axis and each have two substantially circular horizontal walls parallel to one another forming the base surface and the head surface of each toothed wheel 9 and 10. The housing 13 is attached to the base surface of the second toothed wheel 10 by a conventional attachment means. The housing 13 preferably comprises a front wall, two side walls, as well as a base wall and a head wall.

In the embodiment shown, the suspension element S is attached to the rear wall of the housing 13 by its two ends, the object to be exhibited O being suspended on one part of the suspension element S.

In this embodiment, the object to be exhibited O may therefore be move along the X-axis thanks to the carriage 1 moving along the guide rails 4. The object to be exhibited O may be rotated by the second motorised means 3. It may further be moved along the Y-axis by the presence of two reels 11 attached to the rear wall of the housing 13. The two reels 11 are provided so that the suspension element S may be wound and unwound around a horizontal axis, which is rotated by the motor 6 and a third toothed wheel 14 in the winding or unwinding direction.

Furthermore, the reels 11 are provided to be interchangeable, for example, when the suspension element S has to be replaced by a new suspension element S. The reels 11 may be locked by the locking system 12 and then cannot be removed from the housing 13 when said locking system 12 is set to "Closed". The reels 11 may not be locked by the locking system 12 when said locking system 12 is not set to "Closed". When the reels 11 are not locked by the locking system 12, the suspension element S may be replaced by removing each reel 11 from each horizontal axis. When the replacement of the suspension element S is performed and attached to the reels 11, the reels 11 may be returned to their horizontal axis and then be in a locked position when said locking system 12 is set to "Closed".

Figure 5:
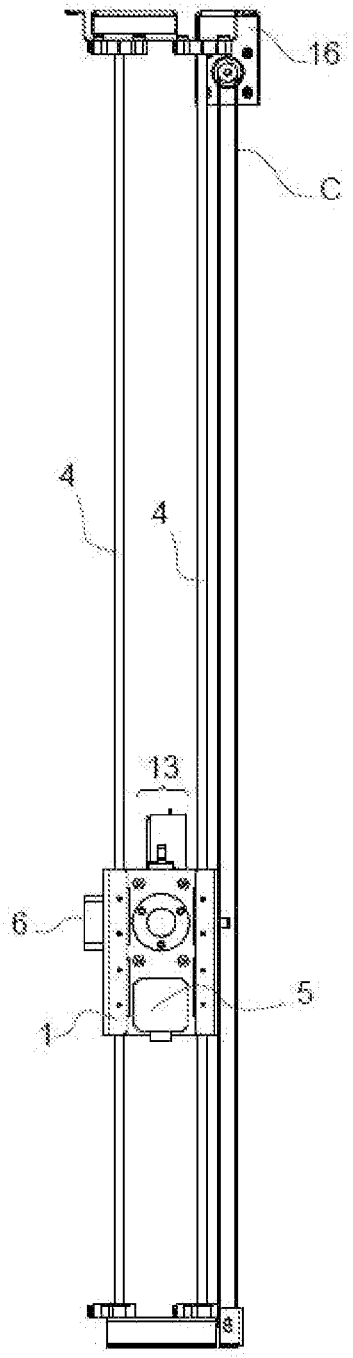
FIG. 5 shows a top view of an embodiment of the technical area of the device according to the present invention.
Figure 6:
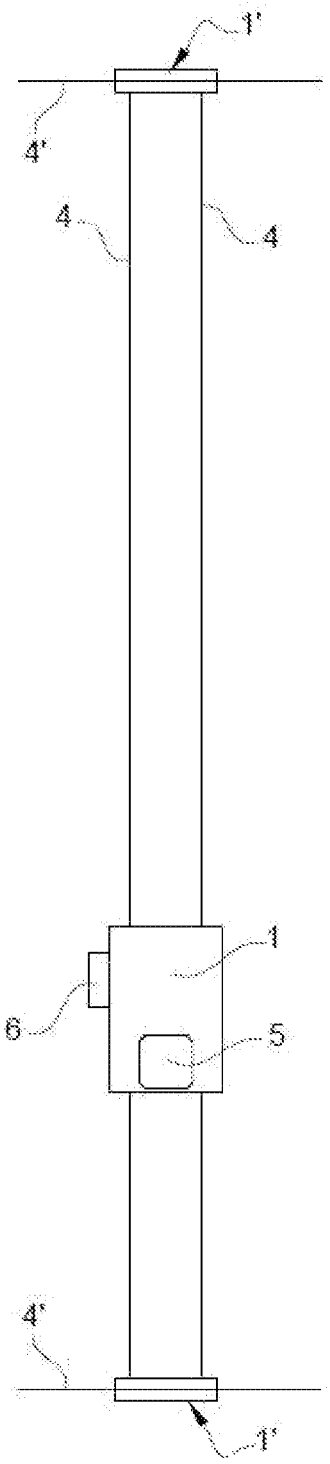
FIG. 6 shows a schematic view from above of another embodiment of the technical area of the device according to the present invention.

A top view of the technical area T as described in FIG. 2 is shown in FIG. 5. As can be seen, the area comprises two guide rails 4 parallel to one another and extending between the two side walls 2 of the device according to the invention. A carriage 1 (first motorised means) is mounted on these guide rails 4 and slides along them in direction of space along the X-axis. The carriage 1 is moved by a system comprising a motor 16 and a cable C. The carriage 1 is connected to the cable C, which, when moved, moves the carriage 1 in the direction of space along the X-axis.

In a preferred embodiment, the technical area T comprises two guide rails 4' perpendicular to the two guide rails 4 parallel to one another. The two guide rails 4' are opposite one another, for example, each connected to the inside of a side wall 2 of the exhibition area E and each connected to the two guide rails 4 by a moveable carriage 1' which slides along the guide rails 4' in the direction of space along the Z-axis. A carriage 1 (first motorised means) is mounted on said guide rails 4 and slides along them in the direction of space along the X-axis. The carriage 1 is moved by a system comprising a motor and a cable, not shown.

Figure 7:
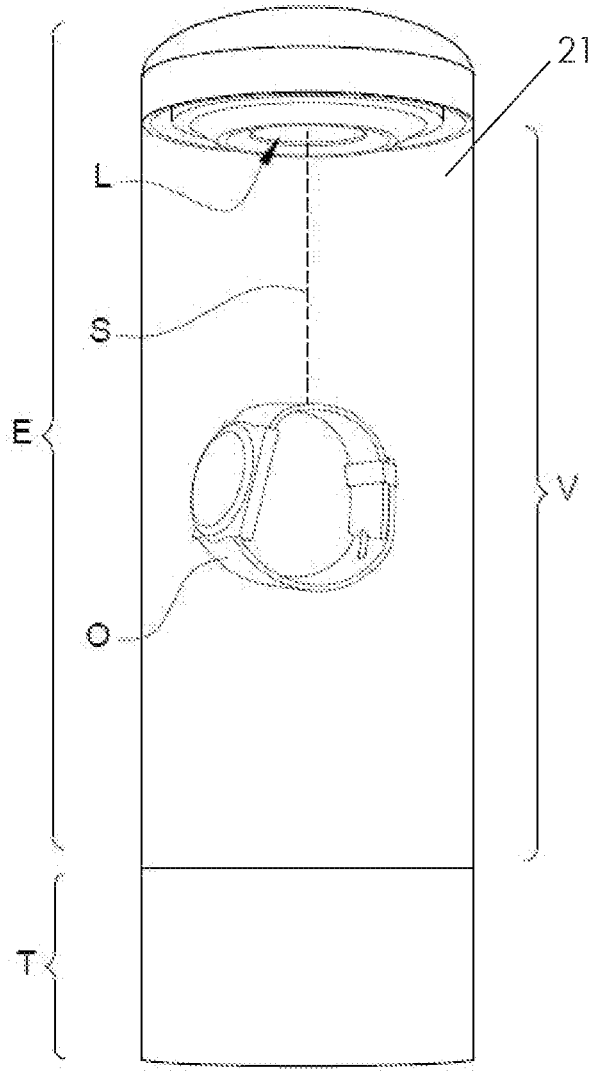
FIG. 7 shows a perspective view of another embodiment of the device according to the present invention.

The device according to the present invention may be in the form of a closed tube as shown in FIG. 7. In FIG. 7, the background F and the visibility portion V are both made from the same display case 21. The display case 21 allows the object O to be seen from all sides (not including the top or bottom) and/or 360°. The display case 21 is made of a transparent material, preferably glass. The display case 21 preferably has a curved shape, preferably a cylindrical shape, preferably a circular cylindrical shape. The display case 21 is preferably the same on the front side as on the rear side of the device. However, in another embodiment, the display case 21 may be different at the rear side and at the front side to improve the transparency at the front and improve the reflective features at the rear.

The at least one light source L (in the display case 21) is preferably arranged above the object O and/or below the object O. The lighting of the light source L reflects from the background F (which is the display case 21) and creates the indirect lighting. The curved shape of the background F or the display case 21 increases the reflection and creates sufficient light effects behind the object O and/or the suspension element S to hide the suspension element S by the light effects of the indirect lighting. The at least one light source L also has the function of illuminating the object by the direct lighting from the light source L. Given that the light source L is arranged above the object O (perhaps arranged slightly towards the front side arranged towards the consumer), the reflections of the direct light of the light source L are reflected at a very small angle so that the reflections of the suspension element S do not leave the display case 21 and/or are not visible to the consumer facing the display case 21, with the consumer looking at the object to exhibited O in said display case 21 which is at the height of the field of vision of the consumer.

In this particular embodiment, three devices according to the invention are used in the same display case. In each of these devices according to the invention is an object to be exhibited O. The devices according to the invention are synchronised with each other in order to move each object in its device in a coordinated manner. For example, the three objects exhibited may move up and down at the same time or, in contrast, in a staggered manner to create a wave-like movement. In this embodiment, the technical area T comprising the means of movement is located below the exhibition area E, at the apex of which is the light source L incorporating, for example, LED technology. The exhibition area E comprises a majority visibility portion V, the wall of which comprises a transparent element, for example glass or Plexiglas. The object to be exhibited O is suspended by the suspension element S in the exhibition area E. The suspension element comprises an inflection point located in a cover above the exhibition area E (technical area T in two parts). One end of the suspension element S is connected to the exhibited object O, the segment passes through a ring to form the inflection point while the other end is connected to at least one means of movement located in the base (technical area T). In this embodiment, the object to be exhibited is rotating and moves from top to bottom. Its trajectory therefore comprises a circular component and a Y component.

Figure 8:
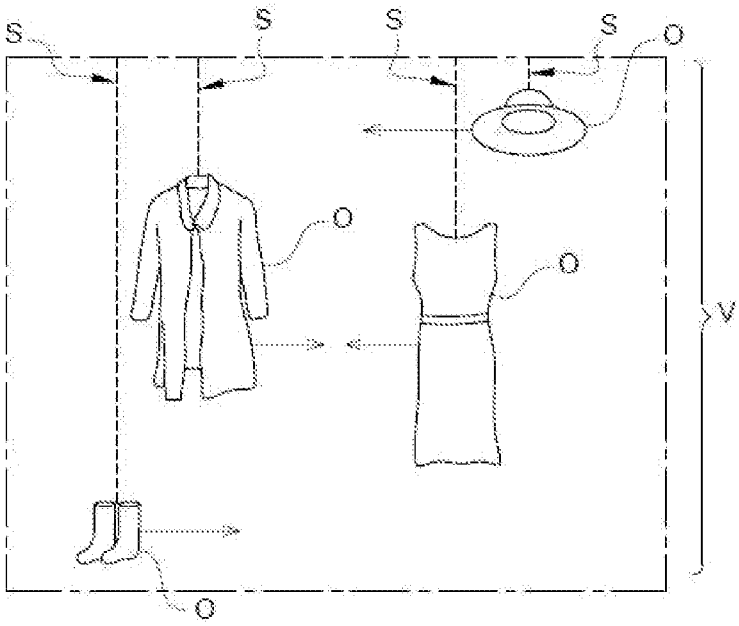
FIG. 8 and FIG. 9 show a front view of a sequential implementation of the device according to the present invention.
Figure 9:
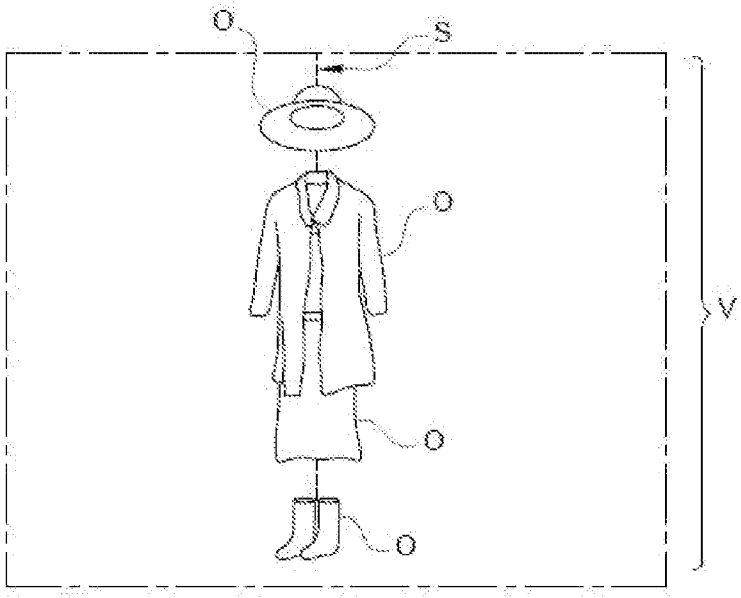

Another sequential implementation of the device according to the present invention according to a time T shown in FIG. 8 and according to a time T1 shown in FIG. 9 comprises implementation means comprising several first motorised means in the technical area T, not shown, the exhibition area E comprising four exhibited objects O each suspended by a suspension element S, for example, one end of the suspension element S is connected to the exhibited object O. The exhibition area E is not enclosed. The visibility portion V of the exhibition area E comprising a background F covered with a dark-coloured fabric material incorporating a plurality of particles, fibres and light-reflecting elements may be seen. The means of movement are synchronised to each other in order to move each object in a coordinated manner. The objects to be exhibited O are moved along a predetermined trajectory, here according to a sideways movement, which allows them to join in the centre of the visibility portion V of the exhibition area E at time T1 or to move in opposite directions to each other at time T. In this embodiment, the trajectory of the exhibited objects O comprises an X component.

Figure 10:
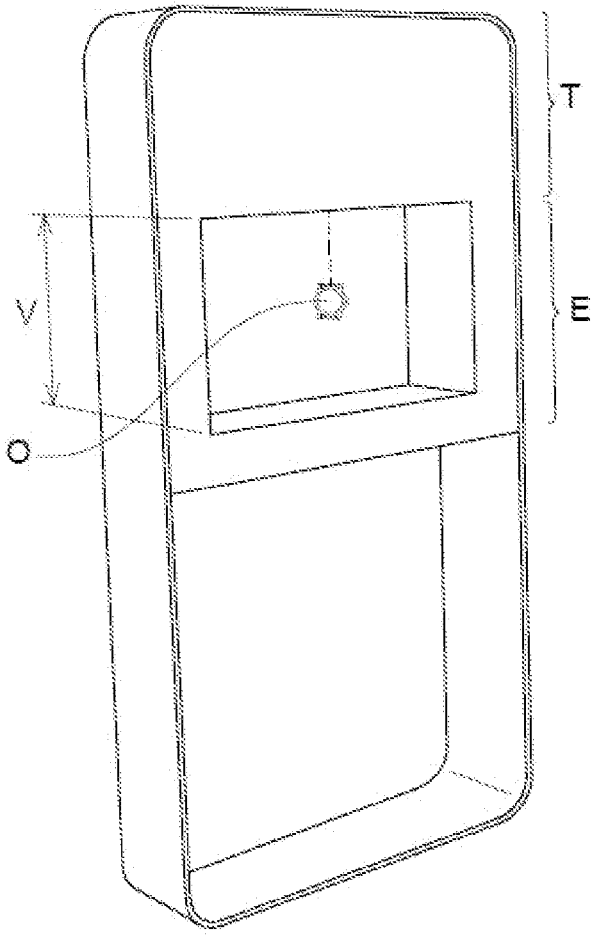
FIG. 10 shows a perspective view of another embodiment of the device according to the present invention.

Another preferred embodiment of the device according to the present invention is shown in FIG. 10. An object display device comprising an exhibition area E comprising a visibility portion V of the object to be exhibited and a technical area T, said exhibition area E being arranged to contain an object to be exhibited O suspended by a suspension element S and a background F covered with a dark-coloured fabric material incorporating a plurality of particles, fibres and light-reflecting elements.

In the embodiment shown, the technical area T is above the exhibition area E. In certain variants, there may be several technical areas T. The technical area T containing the means of movement is, for example, below, while another smaller technical area T may be provided above, simply provided with hooks, rings, pulleys, etc. The said device also comprises a base allowing it to reach a certain height.

Figure 11:
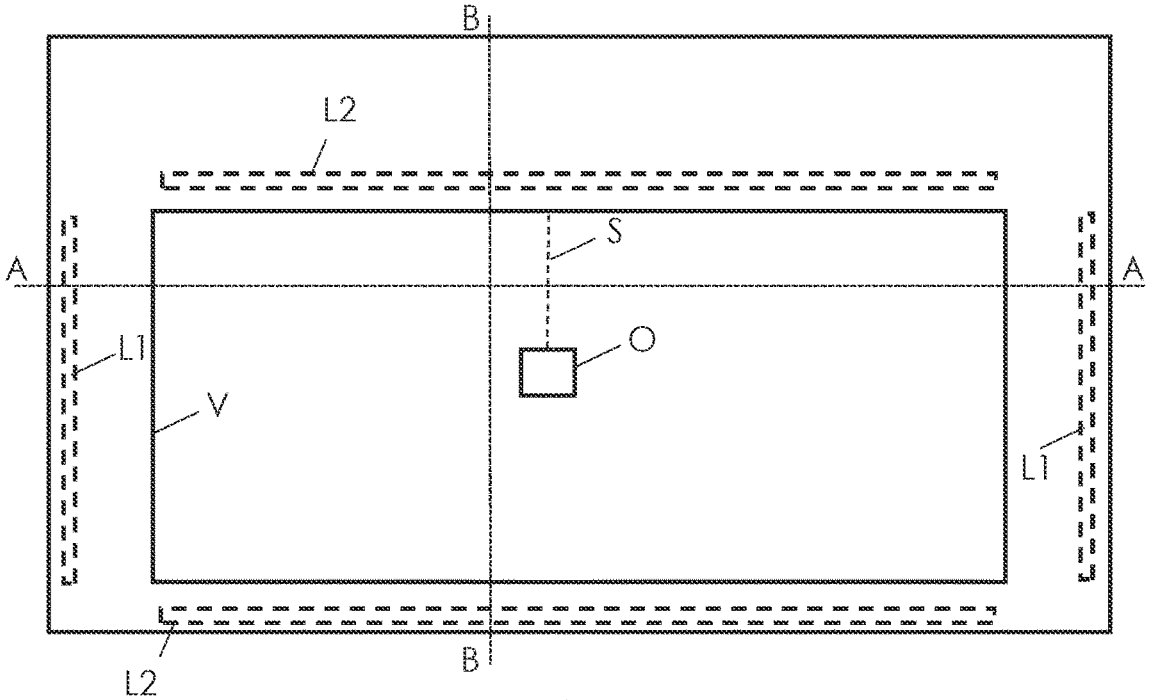
FIG. 11 shows a front view of an embodiment of the device according to the present invention.
Figure 12:
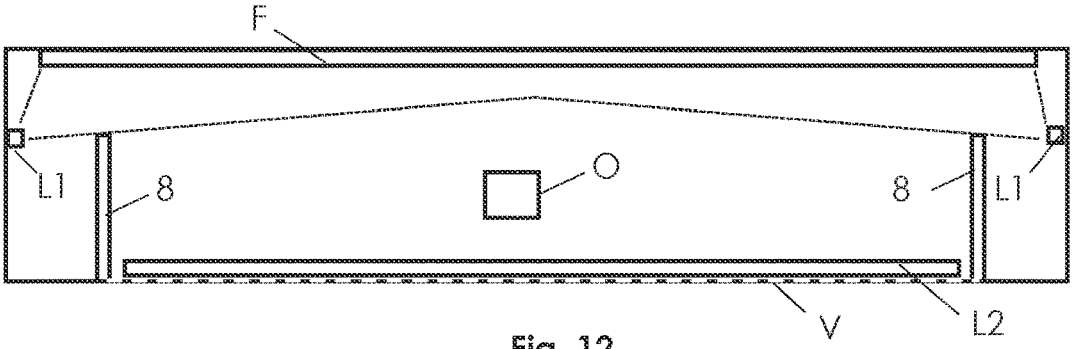
FIG. 12 shows the intersection A-A in FIG. 11.
Figure 13:
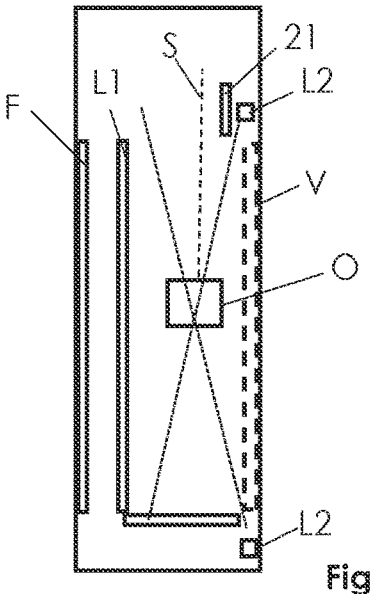
FIG. 13 shows the intersection B-B in FIG. 11.

FIGS. 11, 12 and 13 show the arrangement of the at least one light source L in more detail. The following description of the at least one light source L applies to all the previous embodiments.

Preferably, the at least one light source L comprises at least a first light source L1 and at least one second light source L2. Preferably, the two light sources L1, L2 contribute to keeping or making the suspension element invisible. The invention operates particularly well with both light sources L1 and L2. But the invention may also operate with only the at least one first light source L1 or with only the at least one second light source L2.

The at least one first light source L1 is arranged to create an indirect lighting. The indirect lighting is preferably created by a reflection of the light originating from the at least one first light source L1, preferably by a reflection of the light on the background F. The at least one first light source L1 is preferably arranged on at least one side of the background F or the visibility portion V. The at least one first light source is preferably arranged in the area of the device that is not visible to the consumer, i.e. outside of the visibility portion V. This is shown in FIG. 11, which shows the position of the first light source L1 in dotted lines since it would not normally be visible to the consumer. In the embodiment shown, the at least one first light source L1 is arranged on two opposite sides of the background F or the visibility portion V, preferably the left and right sides. However, it would also be possible to arrange the at least one first light source L1 on the upper and lower sides or on three sides or on the four sides or on one side only. The at least one first light source is preferably arranged between the front side (with the visibility portion V) and the rear side (with the background F) closer to the rear side of the device. The at least one first light source L1 preferably extends on the side(s) where the first light source L1 is arranged. This is preferably achieved by a bar of LEDs extending along the whole side where the at least one first light source L1 is arranged.

The at least one first light source L1 is preferably arranged so that (the rays of) light (direct) from the at least one first light source L1 illuminate the background F. The at least one first light source L1 is preferably arranged so that (the rays of) light (direct) from the at least one first light source L1 do not light up the object by the direct light beams originating from the at least one first light source L1, but only by the indirect light rays reflected by the background F. The lighting (direct) of the background F preferably creates the indirect lighting. Preferably, the device comprises a first blocking means to block direct light rays from the at least one first light source L1 heading towards the object O. Here, the first blocking means is provided by the side walls 8 (side partition). Preferably, there is a space between the first blocking means or the side walls 8 and the background F through which light from the at least one first light source L1 passes to light up the background F (without directly lighting up the object). This is shown in FIG. 12. In the embodiment shown, the indirect light originating from the background F is created by a reflection. However, it would also be possible for the indirect light to be created by transmitting the light originating from the first light source L1 through the background F. In this case, the first light source L1 must be arranged behind the background F.

The at least one second light source L2 is configured to light up the object to be exhibited O and/or the suspension element S, preferably by direct light rays. The at least one second light source L2 is preferably arranged on at least one side of the visibility portion V. The at least one second light source L2 is preferably arranged in the area of the device that is not visible to the consumer, i.e. outside of the visibility portion V. This is shown in FIG. 11, which shows the position of the second light source L2 in dotted lines since it would not normally be visible to the consumer. In the embodiment shown, the at least one second light source L2 is arranged on two opposite sides of the visibility portion V, preferably the upper side and the lower side. However, it would also be possible to arrange the at least one second light source L2 on the left and upper side or on three sides or on the four sides or on one side only. The at least one second light source L2 is preferably arranged between the front side (with the visibility portion V) and the rear side (with the background F) closer to the front side of the device, preferably in the last 30%, preferably in the last 20%, preferably in the last 10% towards the front. The at least one second light source L2 preferably extends on the side(s) where the second light source L2 is arranged. This is preferably achieved by a bar of LEDs extending across the whole side where the at least one second light source L2 is arranged.

The at least one second light source L2 is preferably arranged so that (the rays of) light (direct) from the at least one second light source L2 illuminates the object O and/or the suspension element S. The at least one second light source L2 is preferably arranged so that (the rays of) light (direct) from the at least one second light source L2 is reflected by the suspension element S so that the reflections (specular) are not visible to a consumer observing the object O through the visibility portion V. This is resolved by arranging the at least one second light source L2 near to the front side of the device and/or avoiding direct light rays with light angles extending too far inside the device (towards the rear) and/or arranging the at least one second light source L2 so that the direct light rays extend almost parallel to the visibility portion V or the suspension element S or with small angles towards the suspension element S. Thus, the reflections of the suspension element S also only have small angles towards the suspension element S and are not reflected outside the visibility portion V. The at least one second light source L2 is preferably arranged so that the maximum angle of the light rays towards the suspension element S limits the light angle inside the device to less than 40°, preferably less than 30°, preferably less than 20°, preferably less than 15°. The at least one second light source L2 is preferably arranged so that the reflections from the suspension element S (in all possible positions of the object to be exhibited O in the visibility portion V) are not visible to the consumer observing the object O. Preferably, the device comprises a second blocking means to block the direct light rays from the at least one second light source L2 heading too far inside the device (and thus creating reflections of the suspension element S visible to the consumer). Here, the second blocking means is provided by the lower side of the visibility portion V by the cushioning area 7. Another blocking means 21 is arranged on the upper side of the visibility portion V.

It is understood that the present invention is in no way limited to the embodiments described above and that modifications may arise without departing from the scope of the appended claims.

The invention claimed is:

1. An object display device comprising: an exhibition area and a technical area, wherein the technical area is above the exhibition area, the exhibition area comprising a visibility portion of the object, wherein the exhibition area and/or the visibility portion of the object is visible and the technical area is not visible and/or is hidden behind a front wall, the exhibition area being arranged to contain an object and the technical area containing means for moving the object, isolated in the technical area and arranged to provide movement to the object, the means for moving the object comprising at least one motorised means and at least one transmission arranged to transmit a movement provided by the at least one motorised means to the object, the transmission comprising at least one suspension element arranged to be connected via a first part to the object and via a second part to the at least one motorised means, wherein the at least one suspension element is a wire, the device further comprising a background, and at least one light source, the combination of the at least one light source, the background, and the means for moving is arranged to make the at least one suspension element invisible and to make the object seem to float, wherein the exhibition area comprises the at least one light source located in the exhibition area, wherein the means for moving the object are arranged to provide movement to the object along a predefined trajectory, wherein the at least one light source is arranged to provide an indirect lighting of the object.

2. The object display device according to claim 1, wherein the at least one motorised means comprise:

a first motorised means arranged to provide a first X-axis, Y-axis or Z-axis component in a mathematical reference frame or a first circular component; and/or a second motorised means arranged to provide a second X-axis, Y-axis or Z-axis component which is different to the first, in a mathematical reference frame or a second circular component; and/or a third motorised means arranged to provide a third X-axis, Y-axis or Z-axis component which is different to the first and second component, in a mathematical reference frame or a third circular component; and/or a fourth motorised means arranged to provide a fourth X-axis, Y-axis or Z-axis component which is different to the first, second and third component, in a mathematical reference frame or a third circular component.

3. The object display device according to claim 2, comprising:

a first motor arranged connected at least to the first motorised means and arranged to move the first motorised means; and/or a second motor connected to the second motorised means and arranged to move the second motorised means.

4. The object display device according to claim 3, wherein the technical area further comprises at least two second guide rails extending transversely relative to the at least one first guide rail, the first guide rail being slidably mounted in the second guide rails and being driven by the first motor or by a third motor.

5. The object display device according to claim 3, wherein the second motorised means comprises a first toothed wheel and a second toothed wheel, forming a gear, the first toothed wheel being a pinion of the gear and being moved by the first or second motor, the second toothed wheel being connected to the suspension element and providing a second rotational movement to at least the first part of the suspension element.

6. The object display device according to claim 3, comprising control means comprising an electronic card allowing a first and second movement motor to be controlled.

7. The object display device according to claim 2, wherein the first motorised means comprises at least one axis around which the at least one suspension element winds, the first motorised means being moved by the first motor.

8. The object display device according to claim 2, wherein the at least one suspension element arranged to be connected to the object and to the first motorised means passes through at least one element arranged to provide an inflection point to the first or second movement provided to at least the second part of the suspension element.

9. The object display device according to claim 2, wherein the technical area comprises at least one first guide rail extending in the X-axis direction or in the Y-axis direction and wherein the first motorised means comprises a carriage moveable along the at least one guide rail.

10. The object display device according to claim 1, wherein the at least one light source is arranged to provide an indirect lighting of the object and/or the at least one suspension element by reflecting a direct lighting of the at least one light source by the background.

11. The object display device according to claim 10, wherein the at least one light source comprises:

a first light source for lighting the background by reflecting the direct lighting of the first light source by the background so that the background creates a complex indirect lighting that makes the suspension element invisible to a consumer, wherein the first light source is arranged so that a light from the first light source does not light up the object by direct light beams originating from the first light source; and at least one second light source for lighting with direct lighting the object and/or the at least one suspension element.

12. The object display device according to claim 1, wherein the background and the suspension element reflect light equally.

13. The object display device according to claim 1, wherein the at least one light source comprises LEDs.

14. The object display device according to claim 1, further comprising a cushioning area.

15. The object display device according to claim 1, further comprising brightness sensors.

16. The object display device according to claim 1, further comprising Bluetooth and/or Wi-Fi sensors.

17. An object display device comprising: an exhibition area and a technical area, wherein the technical area is above the exhibition area, the exhibition area comprising a visibility portion of the object the exhibition area being arranged to contain an object and the technical area containing means for moving the object, isolated in the technical area and arranged to provide movement to the object, the means for moving the object comprising at least one motorised means and at least one transmission arranged to transmit a movement provided by the at least one motorised means to the object, the transmission comprising at least one suspension element arranged to be connected via a first part to the object and via a second part to the at least one motorised means, wherein the at least one suspension element is a wire, the device further comprising a background, and at least one light source, the combination of the at least one light source, the background, wherein the background and the visibility portion are made from a display case that allows a 360° view of the object, and the means for moving is arranged to make the at least one suspension element invisible and to make the object seem to float.

18. An object display device comprising: an exhibition area and a technical area, wherein the technical area is above the exhibition area, the exhibition area comprising a visibility portion of the object the exhibition area being arranged to contain an object and the technical area containing means for moving the object, isolated in the technical area and arranged to provide movement to the object, the means for moving the object comprising at least one motorised means and at least one transmission arranged to transmit a movement provided by the at least one motorised means to the object, the transmission comprising at least one suspension element arranged to be connected via a first part to the object and via a second part to the at least one motorised means, wherein the at least one suspension element is a monofilament wire, the device further comprising a background, and at least one light source, the combination of the at least one light source, the background, and the means for moving is arranged to make the at least one suspension element invisible and to make the object seem to float.

* * * * *